United States Patent [19]

Rootsey

[11] 3,958,192

[45] May 18, 1976

[54] DUAL SEPTUM WAVEGUIDE TRANSDUCER

[75] Inventor: James V. Rootsey, Sunnyvale, Calif.

[73] Assignee: Aeronutronic Ford Corporation, Blue Bell, Pa.

[22] Filed: Apr. 23, 1975

[21] Appl. No.: 570,606

[52] U.S. Cl. ..... 333/9; 333/21 A; 333/98 R

[51] Int. Cl.[2] ..... H01P 1/16; H01P 5/12

[58] Field of Search ..... 333/9, 21 R, 21 A, 98 R

[56] References Cited

UNITED STATES PATENTS

| | | | |
|---|---|---|---|
| 3,566,309 | 2/1971 | Ajioka | 333/21 R X |
| 3,843,941 | 10/1974 | Hudspeth et al. | 333/9 |

*Primary Examiner*—Paul L. Gensler
*Attorney, Agent, or Firm*—Robert D. Sanborn

[57] ABSTRACT

A three-port transducer has as a first port a waveguide capable of supporting transverse electric waves of any polarization. The waveguide is divided into three sections by means of a pair of tapered septums which taper in opposing directions. The width of the inner section of the three is made equal to the combined widths of the other two and is coupled to a rectangular waveguide which comprises a second transducer port. The two outer sections are coupled together to a second rectangular waveguide which comprises a third transducer port. The polarization of a signal applied to the first port will determine the amplitude and phase of the signals at the second and third ports.

3 Claims, 5 Drawing Figures

DUAL SEPTUM WAVEGUIDE TRANSDUCER

REFERENCE TO RELATED APPLICATIONS

My copending application, Ser. No. 570,604 filed Apr. 23, 1975 is titled TAPERED SEPTUM WAVEGUIDE TRANSDUCER. This copending application shows a septum of a particular shape which permits substantially improved transducer performance over that of the prior art.

BACKGROUND OF THE INVENTION

It has been known that a tapered septum in a round or square wave-guide could provide a three-port transducer wherein input polarization would control the amplitude and phase of the output components. The tapered septum having a transverse septum portion can be optimized to provide a good signal match but only over a limited frequency band.

SUMMARY OF THE INVENTION

It is an object of the invention to provide a polarization sensitive waveguide transducer that operates over a very great bandwidth.

It is a further object of the invention to employ a pair of oppositely tapered waveguide septums to provide a polarization sensitive energy transfer function to a broadband transducer.

These and other objects are achieved in a transducer constructed as follows. A square waveguide is excited with transverse electric signals that may have any polarization. A pair of tapered septums are located in the waveguide so as to divide it into three rectangular sections, the outer two being of the same width and their combined width being equal to that of the center section. The center section is coupled to a rectangular output waveguide and the outer two sections are merged together and coupled to another rectangular output waveguide. The polarization of the signal in the square waveguide will establish the magnitude and relative phase of the signals transduced to the two rectangular output waveguides. For a circularly polarized input all of the energy will couple to one output port. For oppositely circularly polarized signals all of the energy will couple to the other output port. The transducer is fully reciprocal and, because of its symmetry, operates over a very broad bandwidth.

DESCRIPTION OF THE INVENTION

Figure 1A:
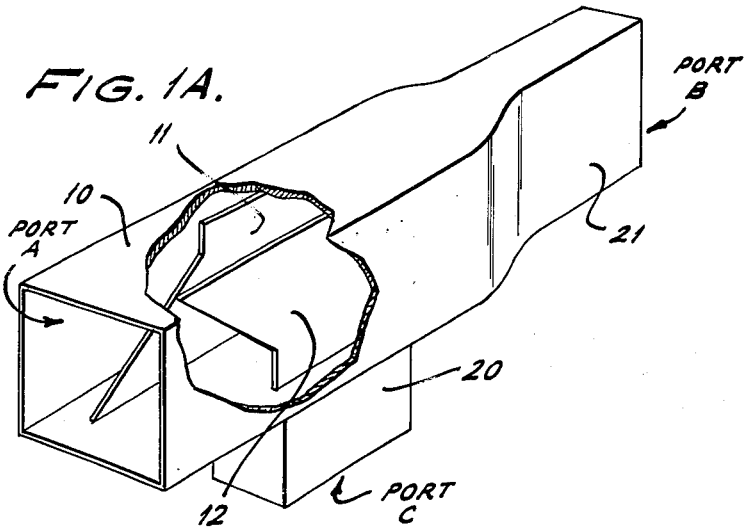
FIG. 1A shows, in partial cutaway, the transducer of the invention.
Figure 1B:
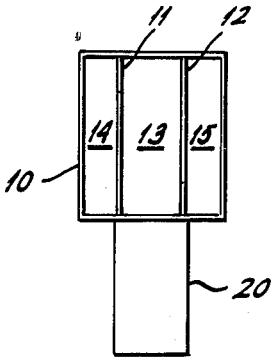
FIG. 1B is an end view looking into port A of FIG. 1A.

FIG. 1A shows the basic elements of the transducer. Square waveguide 10 comprises port A and will support transverse electric $TE_{0,1}$ signals of any polarization. (This is equivalent to the $TE_{1,1}$ mode in a round waveguide.) Two septums 11 and 12 divide the square waveguide into three separate rectangular waveguide sections. As can be seen by the end view of port A, as shown in FIG. 1B, the central rectangular wave-guide 13 has a width equal to the combined widths of outer sections 14 and 15 which are of equal width. In terms of simple power division among the apertures waveguide 13 will support one half of the port A energy while 14 and 15 each will support one forth of the port A energy. The rectangular waveguides are designed to support the $TE_{0,1}$ mode of signal propagation.

Figure 1C:
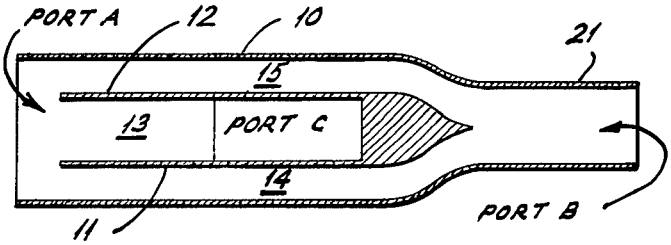
FIG. 1C is a sectional bottom view of the transducer of FIG. 1A.
Figure 1D:
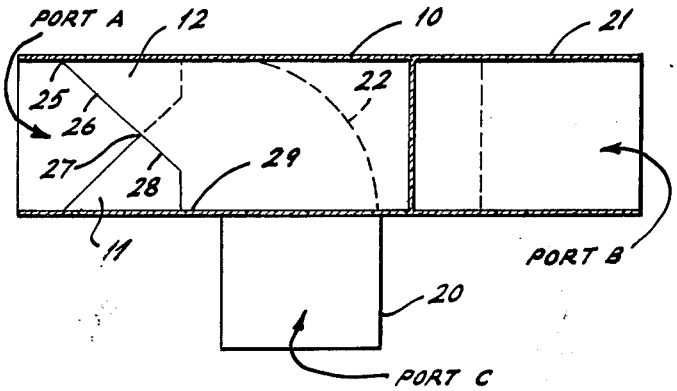
FIG. 1D is a sectional side view of the transducer of FIG. 1A.

FIG. 1C is a bottom view of FIG. 1A so that the observer is looking into port C. The section is taken just past the wall of waveguide 10 where it joins onto waveguide arm 20 which comprises port C. It can be seen that the outer rectangular waveguides 14 and 15 unite or merge together to feed port B via waveguide 21. The inner rectangular waveguide 13 is coupled to port C, or waveguide 20, via an H-plane bend 22 as shown in FIG. 1D which is a sectional side view of the transducer taken just inside the wall of waveguide 10.

Septums 11 and 12 are of the type disclosed in my copending application Ser. No. 570,604 filed Apr. 23, 1975 and titled TAPERED SEPTUM WAVEGUIDE TRANSDUCER. Clearly the septums could each be a simple tapered section, as is well known in the prior art, or they could have other configurations. The important aspect is that the pair of septums are angled oppositely across the square waveguide. This construction provides a symmetry that enables the transducer to operate over extremely wide bandwidths.

Figure 2:
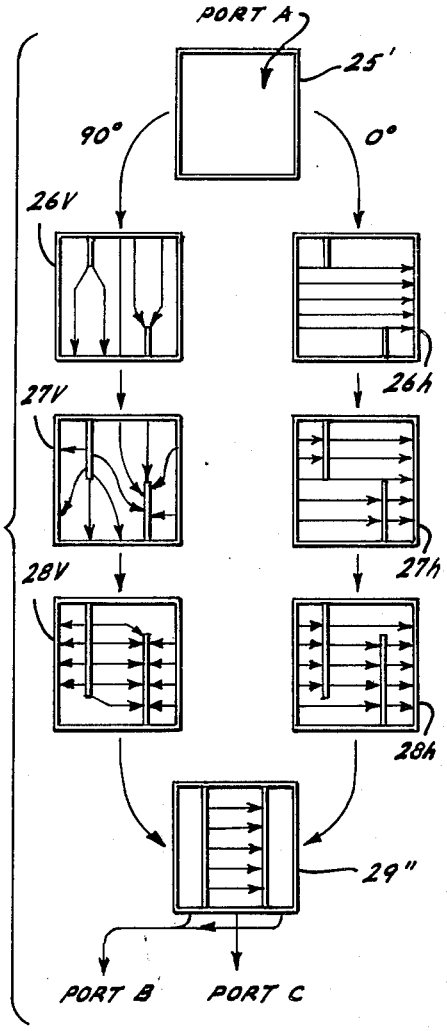
FIG. 2 shows the electric vector propagation through the transducer.

FIG. 2 shows the transducer action on the orthogonal field components of a circularly polarized signal applied to port A of a waveguide of the type shown in FIG. 1A but with the septums 11 and 12 interchanged. The upper section 25' represents such a waveguide at point 25 of FIG. 1D. The right hand series of section **26*h*, 27*h*, and 28*h* show the septum action on the horizontal electric vector which is the 0° or reference vector. The left hand series of sections 26*v*, 27*v*,** show the septum action on the orthogonal electric vector which is the 90° component. Since the input is circularly polarized the 0° and 90° components are not only orthogonal, they are displaced in time by one quarter wavelength.

It can be seen that for the horizontal vector the septums merely divide the signal into three components. Thus the septums have little effect on the horizontal electric vector. However for the vertical vector it can be seen that at section **26*v*, the field is distorted. The distortion progresses through section 27*v* and, at section 28*v*, the vector has been split into three components, the center one of which is out of phase with respect to the outer two. It can be appreciated that the tapered septums make the square waveguide act as a ridged waveguide of ever increasing ridge height. This action will vary the waveguide phase velocity. Since the cutoff frequency of a ridged waveguide is lowered as the ridge increases, the action is to reduce phase velocity with travel. Since the septums had little effect on the horizontal vector, it is clear that the vertical vector will be delayed with respect thereto. If the tapered section is made to have a length that will offset the two illustrated vector components spatial phase difference, the circular polarization will be converted to linear and the vectors that arrive at section 29' will be either in or out of phase and will simply add or subtract depending on their direction. For the conditions shown in FIG. 2,** it can be seen that the vectors in the center section will aid each other while the outer section vectors cancel. Thus all of the input signal will exit at port C.

If the input polarization is circular, but is oppositely rotating, the 90° vector would be at 270° with respect to the horizontal 0° vector. For this condition it can be seen that all of the signal will couple to port B and none to port C.

In terms of linear polarization, a horizontally polarized signal applied to port A will produce equal and in phase signals at ports B and C. A vertically polarized input will produce equal but out of phase signals at ports B and C. Intermediate polarizations will produce intermediate phase conditions at ports B and C.

While the above has described port A as input and ports B and C as outputs, the transducer is fully reciprocal. That is, if a signal is applied to port B, a circularly polarized signal will be present at port A. If a signal is applied at port C, an opposite circularly polarized signal will be present at port A.

Interchanging septums 11 and 12 will produce signals at 26*v*, 27*v* and 28*v* which are the mirror images about a vertical plane of the configurations shown in FIG. 2. Interchanging septums 11 and 12 will not affect the configurations at 28h. Thus it will be seen that with septums 11 and 12 interchanged, for the circular polarization shown signals would cancel at port C and reinforce at port B. For the opposite circular polarization the signals would again exit at port C but cancel at port B.

Because of the symmetry of the septums 11 and 12 in the waveguide 10 the transducer will have extremely large bandwidth capabilities along with a low level of reflected power. For example a greater than 100% wave-guide fractional bandwidth capability has been observed. This is to be compared with the characteristic 25% waveguide fractional bandwidth of the simple single tapered septum transducers of the prior art and the over 50% waveguide fractional bandwidth characterized in my improved single septum transducer as shown in my above-identified co-pending application.

The foregoing has set forth the nature and character of my invention. Clearly there are alternatives and equivalents that will occur to a person skilled in the art. For example round or some other shape waveguide could be substituted for the square waveguide shown and other transmission line structures could be connected thereto. If desired port A of the figures could be connected to a transition secion that converts it to a circular cross section. Also matching elements, ferrite sections, and dielectric elements could be added. Accordingly, it is intended that my invention be limited only by the following claims.

I claim:

1. A three-port waveguide transducer comprising:

a first section of waveguide capable of supporting transverse electric signal energy of any polarization and comprising a first port, a pair of tapered septums located inside said first section of waveguide and extending from opposite walls thereof, said pair of septums being positioned to divide said first section of waveguide into three rectangular channels with the combined width of the outer two of said channels being equal to the width of the central channel, means for coupling said central channel to a second transducer port, and means for coupling said outer two channels to a third transducer port.

2. The transducer of claim 1 wherein said pair of septums have substantially equal but oppositely directed tapers.

3. The transducer of claim 2 wherein said first section of wave-guide is square and said second and said third transducer ports comprise equal width rectangular waveguides.

* * * * *